United States Patent [19]

Rush

[11] Patent Number: 4,695,502

[45] Date of Patent: Sep. 22, 1987

[54] INTERLOCKING LANDSCAPE PLANKING

[76] Inventor: John L. Rush, P.O. Box 548, Lexington, S.C. 29072

[21] Appl. No.: 886,951

[22] Filed: Jul. 23, 1986

Related U.S. Application Data

[63] Continuation-in-part of Ser. No. 764,476, Aug. 12, 1985, abandoned.

[51] Int. Cl.[4] ..... B32B 3/06

[52] U.S. Cl. ..... 428/192; 428/53; 428/54; 428/60; 404/41; 404/46

[58] Field of Search ..... 428/54, 53, 60, 81, 428/192; 47/26, 30; 52/588, 595; 404/41, 46

[56] References Cited

U.S. PATENT DOCUMENTS

| | | | |
|---|---|---|---|
| 30,780 | 11/1860 | Woodworth . | |
| 63,827 | 4/1867 | Augspurger . | |
| 70,162 | 10/1867 | Campbell . | |
| 808,165 | 12/1905 | Murford . | |
| 991,009 | 5/1911 | Myers | 52/595 X |
| 1,701,630 | 2/1929 | Pullar . | |
| 3,440,784 | 4/1969 | Onjukka | 52/595 X |
| 3,474,584 | 10/1969 | Lynch | 428/372 X |
| 3,546,038 | 12/1970 | Smith | 428/60 X |
| 3,732,653 | 5/1973 | Pickett | 52/571 |
| 4,130,272 | 12/1978 | Emmie | 256/22 |
| 4,357,000 | 11/1982 | Tisbo et al. | 256/26 |
| 4,471,012 | 9/1984 | Maxwell | 428/60 X |

*Primary Examiner*—Alexander S. Thomas
*Attorney, Agent, or Firm*—Benoni O. Reynolds

[57] ABSTRACT

Interlocking landscaping planking wherein the opposite edges of each interlocking plank has a tongue and groove of special shape and relative dimensions to permit maximum flexibility in assembling curved landscaping arrangements consisting of multiple numbers of the planks joined side by side. The novel trapezoid or circular shaped tongue is centered vertically is one edge of each interlocking plank, its base indented slightly from the front and back surfaces of the plank to permit and to limit the lateral movement of the plank. The exterior surfaces of the tongue slope or curve inwardly, tapering to a flat apex. The novel trapezoid or circular shaped groove complements the novel trapezoid or circular shaped tongue, but spaced slightly therefrom and is centered vertically in the opposite edge of the plank, its mouth indented slightly from the front and back surfaces of the plank to permit and to limit the lateral movement of the plank. The exterior surfaces of the groove slope or curve inwardly, narrowing to a flat base. The indentations of the mating circular shaped tongues and grooves are spaced apart from one another, when two or more of the interlocking planks are assembled, to permit and limit the lateral movement of the planks. The landscape planking can be used for lawn edging, furniture, retaining walls, area accents or sculpture.

5 Claims, 6 Drawing Figures

INTERLOCKING LANDSCAPE PLANKING

This application is a continuation-in-part of previous application Ser. No. 06/764,476, filed Aug. 12, 1985, now copending (automatically abandoned).

FIELD OF INVENTION

This invention relates to landscaping arrangements, particularly to timber used for lawn edging, furniture, retaining walls, area accents and sculpture.

DESCRIPTION OF PRIOR ART

Over the years, railroad ties or split timbers have served as the basic landscaping tools for edging, retaining walls and the like. The dimensions and very bulk of the items have limited the applications as well as their esthetic appeal for landscaping purposes. The present invention makes possible eye-appealing curves and other innovative designs not possible with prior art resources.

Interlocking tongue and groove in fencing is not new in the art but the interlocking feature was more a means for providing portability and ease of assembly, than for providing eye-appealing curvature (Woodsworth, 1860). Also, the interlocking was in the width of the timber rather than in the thickness of the timber, as in the present invention.

Augsnurger's possible fence of 1867 similarly used notched out sections adjacent the plank ends to make less than 90 degrees angles at the corners of an enclosed area. The notches were in the width of the plank and not in the thickness. Also, the notch was not a complete tongue and groove as in the present invention. A third portable fence was that of Campbell in 1867, showing the use of a hook and a slot for connecting adjacent panels of fencing. Hardware for hinging adjacent vertical end posts is disclosed in the the pentile and eye bolt hinges of Morford's invention of 1905.

Tongue and groove in the thickness of paneling is first revealed in Pullar's invention of 1929 but the thrust of that invention was in the mastic, such as asphalt, which was poured into the recessed body portion of the siding. Unlike the complementary design of the present invention, the tongue was rounded and the groove was rectangular. Mating circular concave and convex end connecting members is also disclosed in Pickett's invention of 1973. Its rotatable pin, coupled with an enlarged stationary socket, permitted interlocking at various angles.

Another approach to flexible connections for vertical fencing is found in Emmie's invention of 1978. Vertical picket slats were joined near the top and bottom by metal stringers having tubular ends received in upper and lower formed metal recesses, allowing rotation of the pickets to form somewhat a curved patch. Hinging again appears in the prior art of Tisbo et al of 1982. A combination of vertically spaced ears having rod apertures and slots to receive a supported rod structure, form a rotatable hinge to adjust the angular position of the adjacent fence sections.

Prior art known to this inventor includes the following U.S. Pat. Nos.:

U.S. Pat. No. 30,780, 11/1986, Woodsworth
U.S. Pat. No. 63,827, 4/1867, Augsnurger
U.S. Pat. No. 70,162, 10/1867, Campbell
U.S. Pat. No. 808,165, 12/1905, Morford
U.S. Pat. No. 1,701,630, 2/1929, Pullar U.S. Pat. No. 3,732,653, 5/1973, Pickett
U.S. Pat. No. 4,130,272, 12/1978, Emmie
U.S. Pat. No. 4,357,000, 11/1982, Tisbo et al

BRIEF SUMMARY OF THE INVENTION

The present invention is an interlocking landscaping plank having a tongue means and a groove means of special relative dimensions on the opposite edges of each interlocking plank. These special dimensions permit maximum flexibility in providing curved landscaping arrangements, heretofore not possible, consisting of multiple members of the interlocking planks assembled side by side. Applications of the present invention include lawn edging, furniture, retaining walls, area accents and sculpture.

According to the preferred embodiment of the present invention, the individual interlocking planks, which are assembled side by side in various configurations, are relatively narrow wooden planks, varying from 4 to 8 inches in width. Usually each interlocking plank is 2½ inches thick and has a tongue means centered vertically along one edge of the plank and a complementing groove means centered vertically along the opposite edge of the plank. These means are for attaching one of the interlocking planks to another of the interlocking planks, the tongue means of one interlocking plank fitting snuggly into the groove means of the adjacent interlocking plank of like configuration. The special shape and dimension of these means permits a graceful, eye-appealing, curved arrangement of the exterior surfaces of the interlocking planks. No mastics are required to keep the interlocking planks joined securely in place. The standard plank length provided is 12 feet although lengths as short as 8 feet and as long as 20 feet are available. Curvature can also be introduced into the length of the interlocking planks by cutting them in ascending or descending lengths after assembly.

One version of novel tongue means is a trapezoid shaped tongue having its base slightly indented preferably 5/16 inch from the front surface of the interlocking plank and indented an equal distance from the rear surface of the interlocking plank. The exterior surfaces of the tongue slope inwardly at a 45 degree angle to the longitudinal axis of the interlocking plank, tapering to an apex which is 5/16 inch in width.

The novel groove means is a complement of the novel tongue means described above and is a trapezoid shaped groove having its mouth indented 5/16 inch from the front surface of the interlocking plank and indented 5/16 inch from the rear surface of the interlocking plank. The exterior surfaces of the groove slope inwardly at a 45 degree angle to the longitudinal axis of the interlocking plank, narrowing to a base which is 5/16 inch in width.

In an alternative verison of the interlocking landscape planking of the present invention, for lawn edging, furniture, retaining walls, area accents and sculpture, each interlocking plank has:

a circular shaped tongue having its base slightly indented from the front surface and the rear surface of the interlocking plank, to permit and to limit the lateral movement of the interlocking plank when two or more of the interlocking planks are assembled, the tongue centered vertically along one edge of the interlocking plank, for attaching the interlocking plank to other like interlocking planks, and a circular shaped groove, complementing conforming to the circular shaped tongue, but spaced slightly therefrom when two or more of the interlocking planks are assembled, the groove having its mouth indented from the front surface and the rear surface of the interlocking plank to permit and to limit the lateral movement of the interlocking plank, the groove centered vertically along the opposite edge of the interlocking plank, for attaching the interlocking plank to other like interlocking planks.

The exterior surfaces of the circular shaped tongue curve inwardly in a circular path corresponding to the arc of a circle, tapering to a flat apex, and the exterior surfaces of the circular shaped groove curve inwardly in a circular path corresponding to the arc of a circle, narrowing to a flat base.

On the standard interlocking landscape planking of the present invention, which is 2½ inches in depth, the circular shaped tongue has its base preferably indented at least ⅛ inch from the front and rear surfaces of the interlocking plank and the circular shaped groove preferably has its mouth indented at least 3/32 inch from the front and rear surfaces of the interlocking plank and these indentations of the mating tongues and grooves are spaced apart from one another when two or more of the interlocking planks are assembled, to permit and limit the lateral movement of the interlocking planking.

The exterior surfaces of the circular shaped tongue curve inwardly in a circular path corresponding to the arc of a circle having a diameter of at least 7/8 inch, in such standard planking of the present invention, tapering to a flat apex which is 11/16 in width and the exterior surfaces of the complementing circular shaped groove curve inwardly in a circular path corresponding to the arc of a circle having a diameter of ⅞ inch, narrowing to a flat base which is ¾ inch in width.

In an indoor application of the present invention the front surface, the rear surface or the front surface and rear surface both, of the interlocking plank, could bear a veneer of a different wood, such as mahogony or walnut.

In assembling the landscaping configurations, the tongue of one interlocking plank is mated to the groove of an adjacent interlocking plank which has a tongue on its opposite edge for mating with still another interlocking plank, thus endless assemblies are possible. It is possible to completely enclose, in a circular fashion, relatively small areas as well as larger areas. Also, it is possible to reverse the curvature of the surfaces of the interlocking planks at will, thus providing serpentine shaped fences or lawn edging. Heights of such a fence or edging can also be varied at will under the present invention, by providing spiraling lengths of interlocking planks to accent particular areas of the landscape or to conform the configuration to the topography of the particular land area. The interlocking planks are adaptable to indoor as well as outdoor arrangements as curved assemblies of the closely mated interlocking planks provide some measure of vertical stability without supplementary posts or other support.

OBJECTIVES OF THE INVENTION

The objectives of the present invention are to provide interlocking planks for general use in lawn edging, furniture, retaining walls, area accents and sculpture, which permit:

(1) creativity in overall landscaping arrangements;
(2) assembly in eye-appealing curves, both horizontally and vertically;
(3) an alternative to Railroad Ties and other less esthetic landscaping mediums;
(4) "in-ground", out of ground and indoor use;
(5) landscaping arrangments less costly than new Railroad Ties and comparably priced with reject Railroad Ties;
(6) installation with common hand tools by a person with no special skills;

Other objectives and advantages will be apparent during the course of the following detailed description.

DETAILED DESCRIPTION OF THE PREFERRED EMBODIMENT OF THE INVENTION

Figure 1:
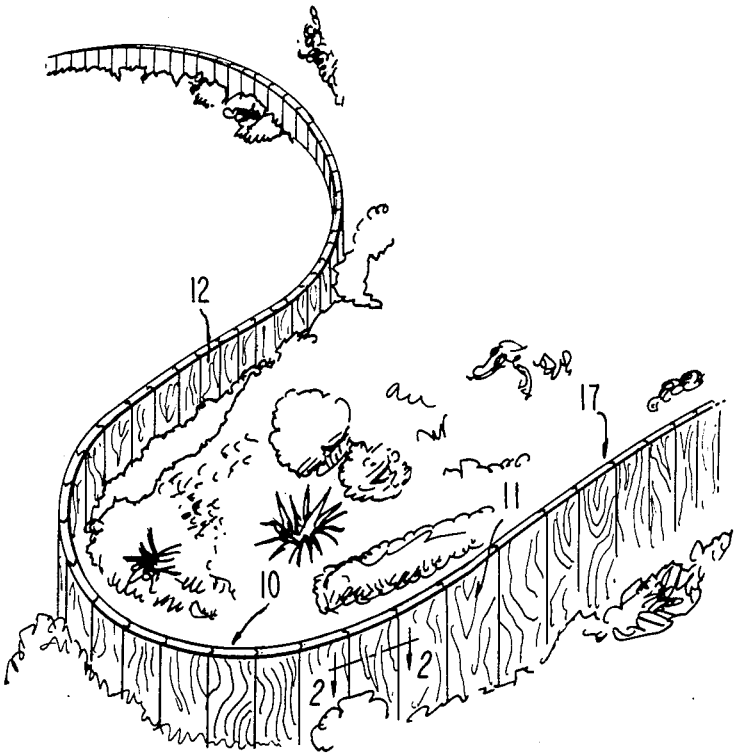
FIG. 1 is a perspective view of interlocking landscape planking, constructed in accordance with the principles of the present invention, showing the interlocking planks assembled in serpentine fashion to accent a planted area.

The interlocking landscaping planking of the present invention comprises relatively thin interlocking planks, shown generally at reference numeral 10, preferably made of close grain Southern yellow pine, which are easily joined to multiple numbers of other like interlocking planks 10, to form eye-pleasing configurations of various curvatures, horizontally and vertically. The interlocking planks 10 are readily installed with common hand tools by a person with no special skills. Throughout the following detailed description of the present invention, like reference numbers are used to denote like parts disclosed in the accompanying FIGS. 1–4.

Figure 3:
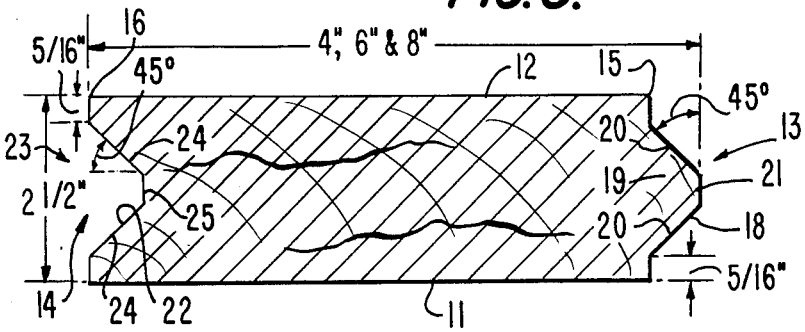
FIG. 3 is a plan cross-sectional view of an interlocking plank of the trapezoid shaped version of the present invention showing the dimensions and relative positioning of the groove along one edge of the interlocking plank and the tongue along the opposite edge of the interlocking plank.

As shown in FIG. 1, interlocking plank 10 of the present invention is designed so that multiple numbers of interlocking plank 10 may be joined side by side to form curved configurations. Each interlocking plank 10 has a front surface 11 and a rear surface 12, and measures ideally 2½ inches in thickness between front surface 1 and rear surface 12. As best shown in FIG. 3, each interlocking plank 10 is provided with tongue means, shown generally at reference numeral 13 and with a groove means, shown generally at reference numeral 14. Each interlocking plank 10 is relatively narrow, preferably in widths from 4 inches to 8 inches.

Figure 4:
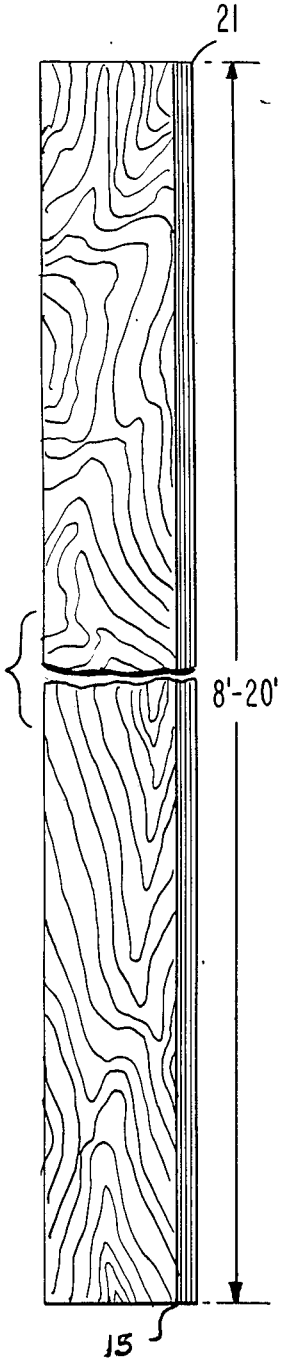
FIG. 4 is a front elevational view of an interlocking plank of the trapezoid shaped version of the present invention, showing the position of the tongue which is centered vertically along one edge of the interlocking plank.
Figure 2:
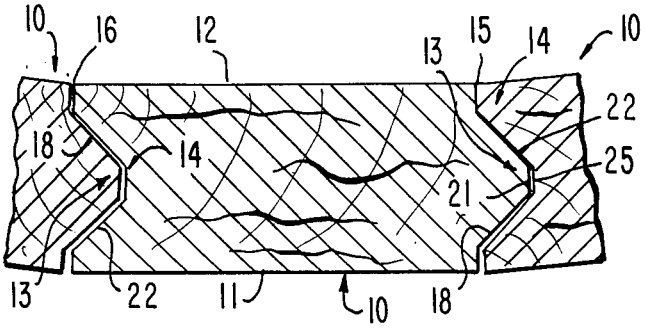
FIG. 2 is a plan view, taken along line 2—2 of FIG. 1, showing the tongue means and groove means of the trapezoid shaped version of the present invention.

Tongue means 13 is centered vertically along one edge 15 of interlocking plank 10, as shown in FIGS. 3 and 4. Complementing groove means 14, as shown in FIGS. 2 and 3, is centered vertically along opposite edge 16 of interlocking plank 10. As best shown in FIG. 2, tongue means 13 and groove means 14 provide the means for attaching one of interlocking plank 10 to another interlocking plank 10. Tongue means 13 of one interlocking plank 10 fits snuggly into groove means 14 of the adjacent interlocking plank 10, permitting a graceful, eye-appealing, curved arrangement of the adjacent front surfaces 11 and rear surfaces 12 of a multiple number of interlocking planks 10. Unlike the prior art, no mastic between tongue means 13 and groove means 14 is required for a stable union of the adjacent interlocking panels 10. The standard plank length is 12 feet, although lengths as short as 8 feet and as long as 20 feet are available. As shown generally at reference numeral 17, in FIG. 1, vertical curvature can be introduced into the length of interlocking planks 10 by cutting the interlocking planks 10 in ascending or descending lengths after assembly.

As shown in FIGS. 2 and 3, the novel tongue means 13 of one version of the present invention is a trapezoid shaped tongue 18, having its base, shown generally at reference numeral 18, indented 5/16 inch from front surface 11 and indented 5/16 inch from rear surface 12 of each interlocking plank 10. The exterior surfaces 20, of tongue 18, slope inwardly at a 45 degree angle to the longitudinal axis of each interlocking plank 10, tapering to an apex 21, which is 5/16 inch in width.

As also shown in FIGS. 2 and 3, the novel groove means 14 of this same version of the present invention is a complement of the novel tongue means 13, and is trapezoid shaped groove 22 having its mouth, shown generally at reference numeral 23, indented 5/16 inch from front surface 11 and indented 5/16 inch from rear surface 12, of each interlocking plank 10. The exterior surfaces 24 of groove 22 slope inwardly at a 45 degree angle to the longitudinal axis of each interlocking plank 10, narrowing to a base 25 which is 5/16 inch in width.

Figure 5:
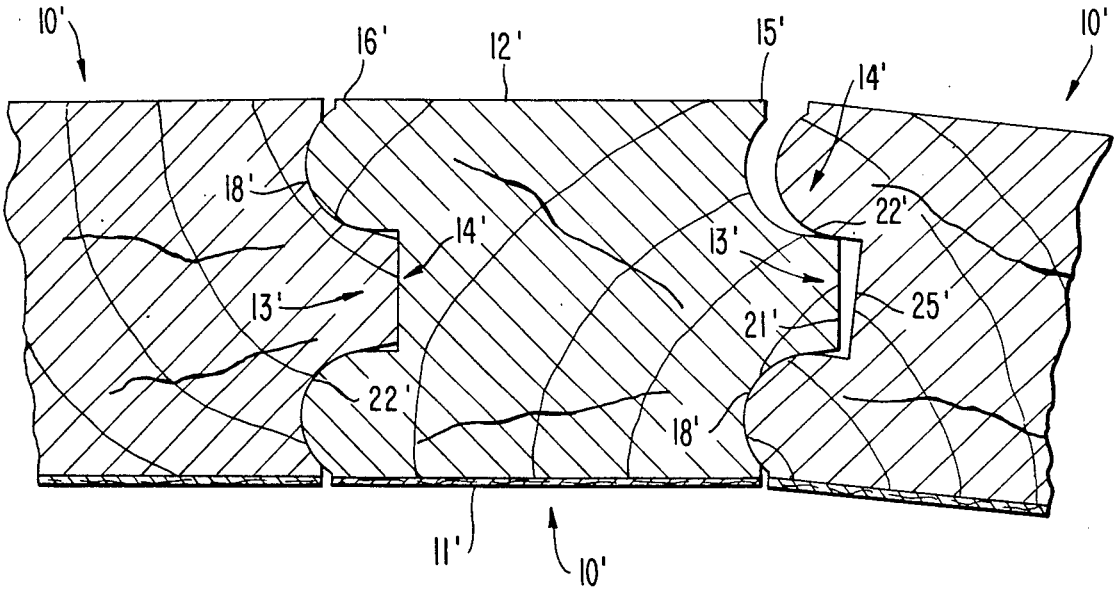
FIG. 5 is a plan cross-sectional view of an interlocking plank of the circular shaped version of the present invention showing the circular shaped tongue and the circular shaped groove.
Figure 6:
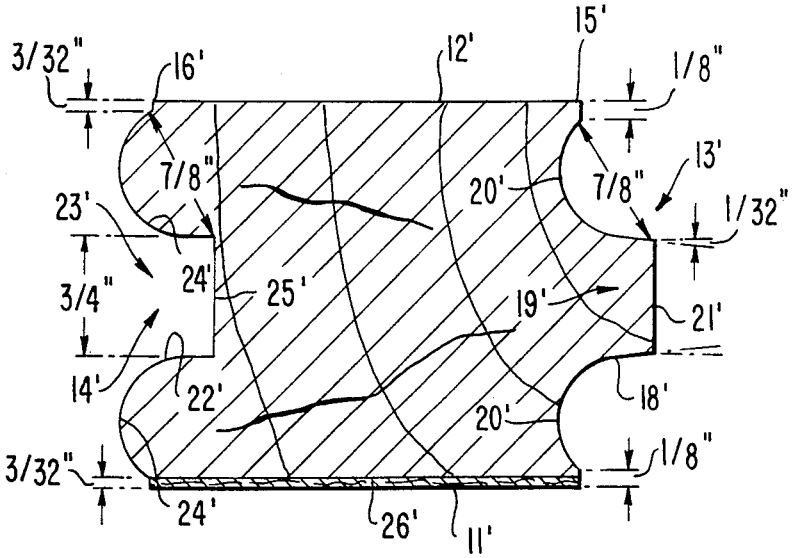
FIG. 6 is a plan cross-sectional view of an interlocking plank of the circular shaped version of the present invention showing the dimensions and relative positioning of the circular shaped groove along one side of the interlocking plank and the circular shaped tongue along the opposite edge of the interlocking plank.

In an alternative version of the present invention, shown in FIGS. 5 and 6, the circular shaped tongue, shown generally at reference numeral 13', is centered vertically along one edge 15' of interlocking plank 10'. Complementing circular shaped groove, shown generally at reference numeral 14', in those same Figures, is centered vertically along opposite edge 16' of interlocking plank 10'. As best shown in FIG. 5, circular shaped tongue 13' and circular shaped groove 14' provide the means for attaching one of interlocking plank 10' to another interlocking plank 10'. Circular shaped tongue 13' of one interlocking plank 10' fits snuggly into circular shaped groove 14' of the adjacent interlocking plank 10', permitting a graceful, eye-appealing, curved arrangement of the adjacent front surfaces 11' and rear surfaces 12' of a multiple number of interlocking planks 10'. Unlike the prior art, no mastic between circular shaped tongue 13' and circular shaped groove 14' is required for a stable union of the adjacent interlocking planks 10'.

As shown in FIGS. 5 and 6, circular shaped tongue 13' of the alternative version of the present invention is a tongue 18', having its base, shown generally at reference numeral 19', slightly indented ($\frac{1}{8}$ inch) from front surface 11' and slightly indented ($\frac{1}{8}$ inch) from rear surface 12' of each interlocking plank 10' to permit and limit the lateral movement of interlocking plank 10' when two or more interlocking planks 10' are assembled. The exterior surfaces 20', of tongue 18', curve inwardly in a circular path corresponding to the arc of a circle having a diameter of at least $\frac{7}{8}$ inch, tapering to a flat apex 21', which is 11/16 inch in width.

As also shown in FIGS. 5 and 6, circular shaped groove 14' of this version of the present invention complements and conforms to circular shaped tongue 13' but is spaced slightly therefrom (1/32 inch or 3 degrees from each side of flat apex 21') when two or more interlocking planks 10' are assembled, to permit lateral movement of interlocking planks 10'. Circular shaped groove 14' is a groove 22' having its mouth, shown generally at reference numeral 23', indented (3/32 inch) from front surface 11' and indented (3/32 inch) from rear surface 12', of each interlocking plank 10' to permit and limit the lateral movement of interlocking planks 10'. The exterior surfaces 24' of groove 22' curve inwardly in a circular path corresponding to the arc of a circle having a diameter of $\frac{7}{8}$ inch, narrowing to a flat base 25' which is $\frac{3}{4}$ inch in width.

In assembling the landscape configurations, such as shown in FIG. 1, tongue 18 (18') of one interlocking plank 10 (10') is mated to groove 22 (22') of an adjacent interlocking plank 10 (10') which also has a tongue 18 (18') on its edge 15 (15') for mating with still another interlocking plank 10, (10') so endless assemblies of multiple numbers of interlocking planks 10 (10') are possible. Thus, it is possible to completely enclose, in a circular fashion, relatively small landscaping areas as well as larger areas. Also, it is possible, with the present invention, to reverse the curvature of front surface 11 (11') and rear surface 12 (12') of each interlocking plank 10 (10') at will, thus providing serpentine configurations as shown in FIG. 1. As shown in FIG. 1, the height of the configurations can also be curved at will by providing spiraling heights to accent particular areas of the landscape or to conform to the topography of the particular land area. The interlocking planks 10 (10') are adaptable to indoor as well as outdoor arrangements, as curved assemblies of the closely mated interlocking planks 10 (10') provide some measure of stability without supplementary posts or other support. For "in-ground" use, each interlocking plank 10 (10') is pressure treated at a rate of 0.05 percent, to prevent deterioration. Usual outdoor installation is to insert each interlocking plank 10 (10') to a depth of at least 6 inches below the frost line. The preferred depth into the ground depends on the characteristics of the soil as well as the overall length of the particular interlocking plank 10 (10') being installed. Sandy soil would require deeper insertion than clay soil. The usual insertion depth is 24 inches but somtimes insertion as deep as 36 inches is necessary. Installation in this manner, by insertion, obviates the need for support posts, particularly for the curved configurations.

For indoor use, front surface 11' or rear surface 12' or front surface 11' and rear surface 12', both, could bear a veneer of another wood, e.g. mahogony or walnut.

I claim:

1. Interlocking landscape planking for lawn edging, furniture, retaining walls, area accents and sculpture, wherein each interlocking plank comprises:

front and rear surfaces, a tongue along one edge of the plank, for attaching said interlocking plank to other like interlocking planks, said tongue having a flat apex which is 11/16 inch in width, the side of which flat apex taper outwardly from said flat apex and continue in a circular arc corresponding to the arc of a circle having a diameter of at least $\frac{7}{8}$ inch toward the front and rear surfaces, respectively, of said interlocking plank, extending to a point slightly removed from said front and rear surfaces, and a groove along an edge of the plank opposite the tongue, for attaching said interlocking plank to other like interlocking planks, said groove having a flat base which is $\frac{3}{4}$ inch in width, the sides of which flat base extend at a 90 degree angle to the plane of said flat base and continue outwardly from said flat base in a circular arc corresponding to the arc of a circle having a diameter of at least $\frac{7}{8}$ inch toward the front and rear surfaces, respectively, of said interlocking plank, extending to a point slightly removed from said front and rear surfaces.

2. The interlocking landscape planking of claim 1 wherein said interlocking planking is $2\frac{1}{2}$ inches in thickness and said tongue has its base indented at least $\frac{1}{8}$ inch from the front and rear surfaces of said interlocking plank and wherein said groove has its mouth indented at least 3/32 inch from the front and rear surfaces of said interlocking plank, to permit and limit the lateral movement of said interlocking planking when two or more said interlocking planks are assembled.

3. The interlocking landscape planking of claim 1 wherein said front surface of said interlocking plank bears a veneer.

4. The interlocking landscape planking of claim 1 wherein said rear surface of said interlocking plank bears a veneer.

5. The interlocking landscape planking of claim 1 wherein said front surface and said rear surface of said interlocking plank both bear a veneer.

* * * * *

UNITED STATES PATENT AND TRADEMARK OFFICE

CERTIFICATE OF CORRECTION

PATENT NO. : 4,695,502

DATED : September 22, 1987

INVENTOR(S) : John L. Rush

It is certified that error appears in the above-identified patent and that said Letters Patent is hereby corrected as shown below:

In the Specification, Column 6, line 47 of the Patent, delete "0.05" before "percent" and substitute -- 0.5 -- therefor.

Signed and Sealed this

Tenth Day of May, 1988

*Attest:*

*Attesting Officer*

DONALD J. QUIGG

*Commissioner of Patents and Trademarks*